United States Patent [19]

Csák

[11] Patent Number: 4,651,481

[45] Date of Patent: Mar. 24, 1987

[54] PROGRESSIVE SHOCK ABSORPTION SYSTEM FOR REDUCING THE SEISMIC LOAD OF BUILDINGS

[75] Inventor: Béla Csák, Budapest, Hungary

[73] Assignee: The Budapesti Muszaki Egyetem, Hungary

[21] Appl. No.: 622,684

[22] Filed: Jun. 20, 1984

[30] Foreign Application Priority Data

May 22, 1984 [HU] Hungary ..... 1977/84

[51] Int. Cl.[4] ..... E02D 27/34; E02D 31/08; E04B 1/98; E04H 9/02

[52] U.S. Cl. ..... 52/167

[58] Field of Search ..... 52/167

[56] References Cited

U.S. PATENT DOCUMENTS

| | | | |
|---|---|---|---|
| 440,938 | 11/1890 | Anthoni | 52/167 |
| 1,651,411 | 12/1927 | Porter | 52/167 |
| 2,690,074 | 9/1954 | Jones | 52/167 |
| 3,105,252 | 10/1963 | Milk | 52/167 |
| 3,212,745 | 10/1965 | Lode | 52/167 |
| 3,347,002 | 10/1967 | Penkuhn | 52/167 |
| 3,916,578 | 11/1975 | Forootan et al. | 52/167 |
| 4,121,393 | 10/1978 | Renault et al. | 52/167 |
| 4,187,573 | 2/1980 | Fyfe et al. | 52/167 |
| 4,258,516 | 3/1981 | Mori et al. | 52/167 |
| 4,328,648 | 5/1982 | Kalpins | 52/167 |
| 4,330,103 | 5/1982 | Thuries et al. | 52/167 |

FOREIGN PATENT DOCUMENTS

| | | | |
|---|---|---|---|
| 723083 | 4/1980 | U.S.S.R. | 52/167 |

*Primary Examiner*—Carl D. Friedman
*Assistant Examiner*—Michael Safavi
*Attorney, Agent, or Firm*—Handal & Morofsky

[57] ABSTRACT

The present invention relates to a system comprising of motion-damping sandwich elements and energy-absorbing steel mandrels arranged between the building foundation and the superstructure, where at least a certain part of the sections receiving the steel mandrels in the building foundation is formed as a sliding block movable in the horizontal direction and embedded with expansion gaps in all directions in relation to the foundation. These blocks are placed onto sliding layers of low friction coefficient. During the earthquake, the fixed spring elements will be deformed. As soon as the deformation reaches a fixed limit value, the spring elements embedded with the lowest expansion gap step in and increase the rigidity. The stepping in of the further springs can be controlled by selection of the expansion gaps.

10 Claims, 3 Drawing Figures

PROGRESSIVE SHOCK ABSORPTION SYSTEM FOR REDUCING THE SEISMIC LOAD OF BUILDINGS

Subject of the invention is a system for progressive shock absorption to reduce the seismic load of buildings, where motion-damping sandwich-system and energy absorbing steel blocks are arranged between the building foundation and the superstructure.

It is generally known that the various buildings are exposed to seismic loads when the effect of the seismic shocks accelerating motions are brought about in parts of the building.

One of the methods for reducing the seismic forces is to reduce the size of the buildings, and significant results have been achieved on this field along the development of the architecture.

Another possible method of reducing the seismic forces is providing an intermediate system between the foundation and superstructure of the building, which is suitable for absorption of the energy arising during the seismic shocks. The methods for the reduction of the different seismic loads essentially follow this pattern.

In some cases, weaker wall parts are built in between the foundation and the superstructure, which break up upon seismic motion, and the so produced deformations absorb a certain part of the energy. Such walls are erected by using mortars for jointing the building units, which are suitable to withstand the major deformations.

According to other methods, energy absorbing paddings are built in between the foundation and the superstructure, as well as between the foundation and the ground. According to one of these methods rollers of restricted motion are emplaced between the foundation and the superstructure, and sliding panels made of synthetic material between the foundation and the ground.

According to another method, steel elements withstanding the torsional and longitudinal deformations are built in between the ground and the foundation.

Sandwich-type rubber springs are, in other cases, emplaced between the foundation and the rising structure.

Other shock absorbing methods have also been worked out, where the energy absorption takes place with the deformation of the reinforced concrete pillars. According to a further method, so-called disengaging joints are built in on the ground floor of the building. The characteristic feature of these is that they become ruined upon exposure to forces exceeding the specified limit force and thus they prevent the excessive development of the horizontal accelerations and the transfer of such accelerations to the superstructure.

According to the Swiss patent specification No. 584 333, spherical, liquid receptacles are supported with hinged pillars. A rigid ring is welded to the bottom of the spherical receptacle, which is interconnected with the foundation through three horizontal steel bars. The end parts of the bars are hinged to the ring and to the foundation and telescopic shock absorbers are arranged in the vicinity of their central part.

This method, however, is applicable only within a limited range, it is out of the question in case of buildings. The complexity and the cost of the system is a disadvantage, and its maintenance requires considerable live labour.

A method is described in the U.S. Pat. No. 394,895, wherein a small mass is connected to a given swinging mass, e.g. to a building with the aid of a rigid arm and fix support in such a way that in case of acceleration of the large mass, the small mass accelerates in opposite direction. The extent of damping is controlled by the geometric ratios of the rigid arm interconnecting the two masses.

The background of the method is realistic and obvious, but the actual mechanical construction is rather expensive. On the other hand, damping is effective only along a single plane /along the plane of support/its extension to other directions is very complicated and difficult.

According to the U.S. Pat. No. 4,121,393, elastic sandwich elements are built in between the building foundation and the superstructure, thereby reducing the transfer of the ground motions. Friction developes between the pointed parts of the sandwich elements upon the effect of the vertical load and this friction force is utilized for damping of the oscillations. The fundamental shortcoming of the proposal is that the extent of the damping can not be accurately followed with calculation—since the friction can not be regarded as constant value during the recurring oscillations partly because of the deformation of the elements and partly for the change in the roughness properties of the material along the contacting surfaces.

None of the above described methods is capable of solving the problem outlined above. Their main shortcoming is that they are not capable of carrying safely the vertical loads when the structural elements become damaged. Serious stability problems arise on the account of major, mainly horizontal deformations. Consequently should the upper parts of the building remain undamaged upon the effects of the seismic loads, the building will still collapse as a result of the instability of the pillars. In case of the known systems it represents a serious and so far unsolved problem that the direction of the seismic shocks and the ensuing seismic forces is entirely optional. The structural design does not enable the adaptation to the optionality, i.e. that the rigidity should be nearly identical in all directions along the horizontal plane. Experiments were conducted with springs built up with different rubber hoses, but because of the merely elastic deformation of the rubber, the method did not prove to be suitable for the realization of the sufficient energy absorption.

A substantial part of the difficulties arise in connection with the known methods is of a financial nature. In case of the average building, the cost of the load bearing structures amount to about 40% of total cost of investment, while the remaining 60% is allotted to other structures, such as the partioning walls, doors and windows, facings, sanitary installations and to the other permanent installations associated with the building. In case of more intensive earthquakes a considerable part of these becomes useless even if the load bearing structures do not become completely ruined. The more serious problem, however, is caused by the repair and reinforcement of the load bearing structures, and in most cases it is nearly impossible to regain the original load bearing properties of the load bearing structure upon recurrence of the earthquake.

Subject of the European patent application No. 0056258, is also a system for reducing seismic loads of buildings. A spring system is built in between the foundation and the rising structure which enables the development of the seismic forces equivalent to the horizontal forces of the wind load, and in case of higher forces it yields, and thus in the wake of its own plastic deformation it becomes automatically unsuitable to transmit the more intensive forces.

The spring system includes a motion-damping part having high elastic deformation capacity, and a highly efficient plastic, energy-absorbing part. The motion-damping part is formed as an elastic sandwich system assembled from rubber sheets placed on each other and from the surrounding steel plates, while the energy-absorbing part is formed as a set of steel mandrels extending into the surfaces of the foundation and the superstructure facing each other, and unsuitable for the absorption of loads exceeding the maximal wind load.

The structure represents progress compared to the earlier ones, since it prevents the transfer of force effects higher than the certain predetermined usual forces the building is exposed to. At the same time, however, it also has its drawback for the following reasons.

The seismic forces arising in the buildings are the less intensive, the lesser is the rigidity of the springs built in between the foundation and the superstructure. The lower limit of this rigidity is determined by the criterion that no plastic deformations should occur in the spring system upon the effect of the maximal wind load on the building.

In case of such an intensive earthquake, the acceleration which would induce higher horizontal seismic forces on the building than the maximal wind load, would cause the spring system to become plastic. In this way, it will be incapable of transmitting the horizontal forces exceeding the maximal wind load.

The deformations of the spring system in plastic condition will also be plastic, therefore indefinite. The limit values of the plastic deformation can be calculated at from the inequality of the kinetic and potential energies.

It may be a requirement even in case of an average building, that the plastic deformations should not overstep an upper limit specified for some reason.

This requirement appears even more in case of special buildings such as industrial installations, nuclear reactors, power plants, etc. Fixing of the upper limit of the deformations may be a strict requirement, which depends first of all on the nature, or function of the building.

SUMMARY OF THE INVENTION

It is, accordingly the object of the present invention to provide a system ensuring the progressive shock absorption in order to reduce the seismic load of the building, which allows the formation of the progressive shock absorption hardening according to the deformation.

The object of the invention is a system developed from a motion-damping sandwich system and the energy-absorbing steel mandrels arranged according to the known method between the building foundation and the superstructure, where at least a certain part of the sections receiving the steel mandrels in the building foundation is formed as a sliding block movable in the horizontal direction and embedded with expansion gap in all directions in relation to the foundation. These blocks are placed onto sliding layers of low friction coefficient, e.g. onto graphite or Teflon layers.

These expansion gaps are filled out suitably with elastic padding, e.g. with foam rubber saturated with bitumen.

At least a certain part of the different sliding blocks is embedded with different expansion gaps suitably in such a way that the size of the different expansion gaps is progressively increased in size, which in case of the gradually increasing force effects allows the continuous operation of the increasing number of steel blocks and their plastic deformation.

The possibility of the progressive shock absorption is consequent upon the method of building in. Namely only as many fix spring elements are built in between the foundation and the superstucture as necessary for the predetermined extent of the deformation. As soon as the deformation—as well in case of wind load—reaches this fixed limit value, further spring elements step in to increase the rigidity. The introduction of the further springs can be controlled by selection of the expansion gaps. Thus the spring elements will begin to exert resistance against the horizontal movement only when the side of the expansion gap impacts the sliding block. The impact is elastic, thus dynamically it does not represent a sudden increase of the force or resistance. Since the direction of the seismic shock may be entirely optional, the expansion gap is naturally such as to be capable of ensuring the displacement in all directions along the horizontal plane. The extent of the expansion gap conforms to the extent of the specified deformation. Another aspect in the selection of the expansion gap is whether the deformation of the functioning springs is to be elastic-plastic and what is to be extent of the plastic deformation.

The extent of the plastic deformation is essential in respect to the energy absorption, on the other hand the introduction of the new spring elements represents elastic restoring force during the swinging motion. Thus this shock absorption method is capable of ensuring the seismic forces on the upper part of the building shall not be higher than the resultant of the maximal wind load, the deformations should not overstep a specified limit and that the energy absorption process shall be ensured during the whole time of the earthquake.

BRIEF DESCRIPTION OF DRAWINGS

Other objects and advantages of the invention are described in the following detailed description and drawings, in which.

DESCRIPTION OF THE PREFERRED EMBODIMENT

Figure 1:
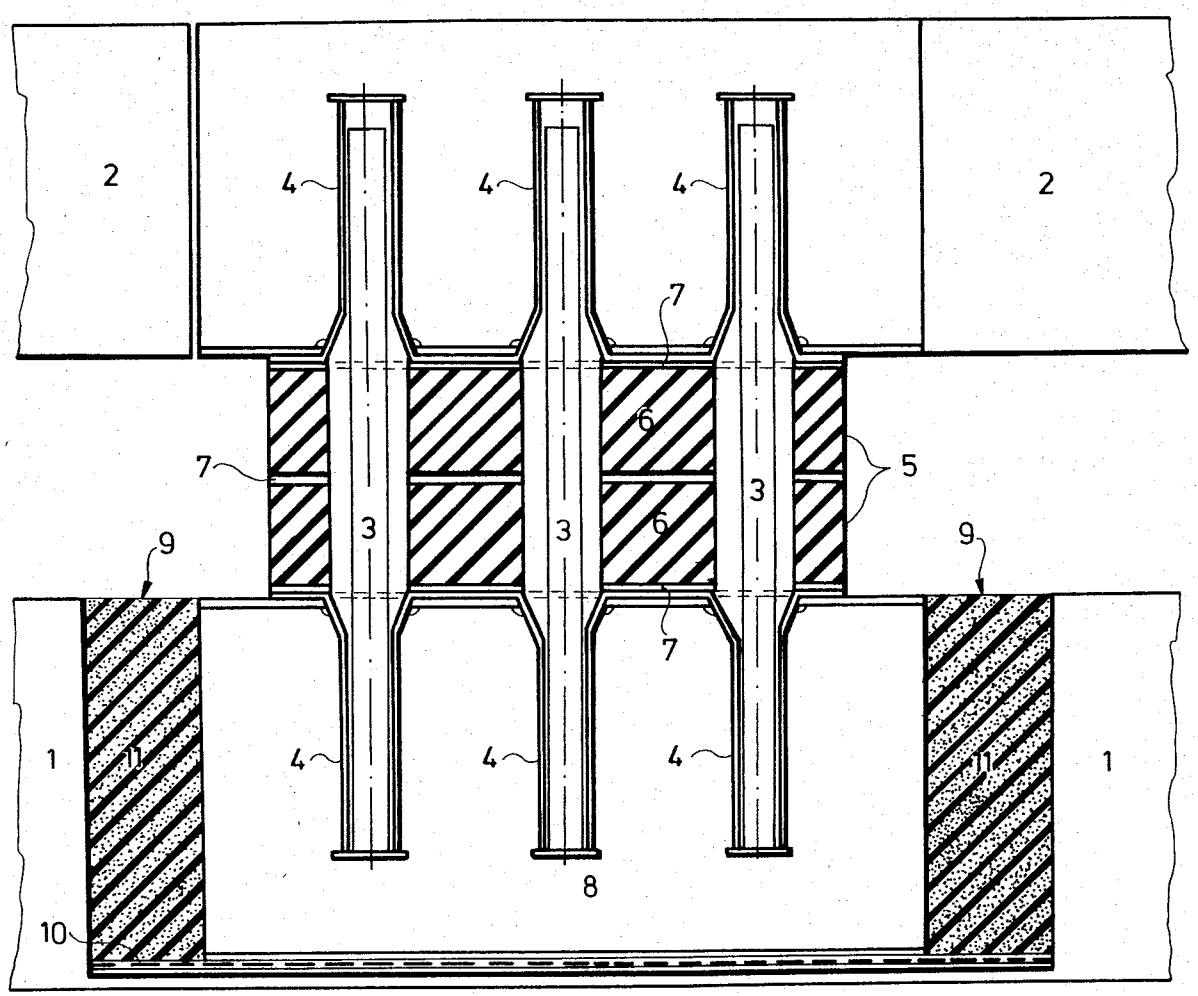
FIG. 1 is a sectional view of one element of the system according to the invention and FIG. 2 is a diagram of the system built up with the elements shown in FIG. 1.

FIG. 1 shows the construction of the system according to the invention built in between the foundation 1 and the superstructure 2 of the building.

The basic elements of the progressive shock absorption system are the mild or soft steel mandrels 3 which ensure the connection between the foundation 1 and the superstructure 2. These mild steel mandrels 3 are arranged in the cavities of the foundation 1 and the superstructure 2 suitably in such a way that bushings 4 made of steel tube are built into the reinforced concrete panels or into the supporting grids. The bushings 4 are surrounded suitably with strong spatial hooping for stabilizing their positions. Moreover the strength of the hooping as well as the part of the reinforced concrete panel, block or supporting grid in the vicinity of the bushings is increased.

Conventional sandwich system 5, surrounding the mild steel mandrels 3, is arranged between the foundation 1 and the superstructure 2. The sandwich system 5 consists of rubber sheets 6 and metal sheets 7, it ensures the spring support of the superstructure 2. This assembly forms the elastic motion-damping part of the building.

It is most important that the mild steel mandrels 3 on the bottom fit not directly into the reinforced concrete panel of the foundation or into the supporting grid, but into the independently embedded sliding block 8. The sliding block 8 is arranged in the foundation 1 with expanstion gap 9 in such a way that its horizontal displacement is ensured by the sliding surface 10. The sliding surface 10 is suitably a graphite or teflon layer.

The expansion gaps between the foundation 1 and the sliding block 8 are filled out with padding 11. The padding is made of a loose, soft material which prevents the horizontal displacement of the sliding block 8 in relation to the foundation 1, and at the same time it ensures elastic impact. The material of the padding 11 in the system shown in FIG. 1 is foam rubber saturated with bitumen.

The use of the sliding block 8 prevents the direct transfer of the earth motions through the foundation 1, and it allows the optimal extent of the seismic displacement without its transfer to the superstructure 2.

In case of the earlier known systems the foundation moved off together with the strata and it displaced the lower part of the steel mandrels too, in this way they were subjected to immediate elastic, then plastic deformation. Though the fitting of the mandrels allowed a few mm displacement, this however is practically insignificant in respect of operation of the system. The elasticity of the system could be influenced only by changing the thickness of the steel mandrels.

On the other hand, the invention enables the ground displacement even to the extent of a decimeter, without deformation of the mild steel mandrels, if the widths of the gaps are different and show a significant distribution.

In this situation, if the size of the expansion gaps are arranged with stepped variation between the different units, it is possible to ensure that gradually further and further units step into the increasing sequence of the expansion gaps, and the absorption of the increasing energy may be achieved through the deformation of the increasing number of the mild steel mandrels.

At the same time the arrangement according to the invention ensures that the deformation of just as many mild steel mandrels takes place as necessary for the protection of the building.

Figure 2:
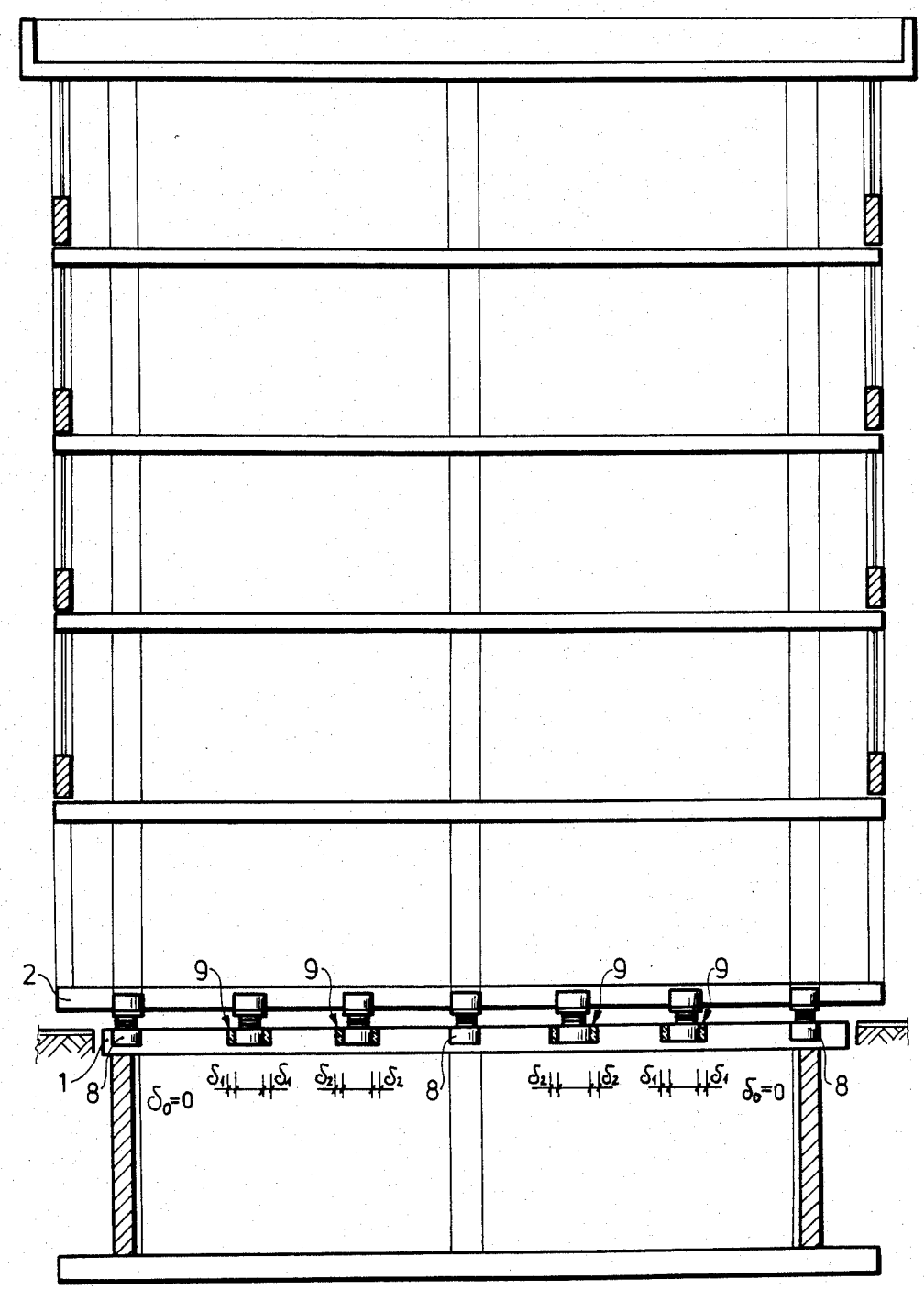

Operation of the system in case of an earthquake motion is illustrated in FIG. 2.

As shown in the diagram, the sliding blocks 8 are arranged in the foundation 1 of the building so that the width of the expansion gaps 9 varies at the different positions. The sliding blocks 8 situated along the edges and in the centre are essentially arranged without expansion gaps, i.e. $\delta=0$. These sliding blocks 8 ensure the horizontal resistance of the building against the wind effect.

The further sliding blocks 8 are arranged with expansion gaps of $0<\delta_1<\delta_2< \ldots \delta_n$ width.

Figure 3:
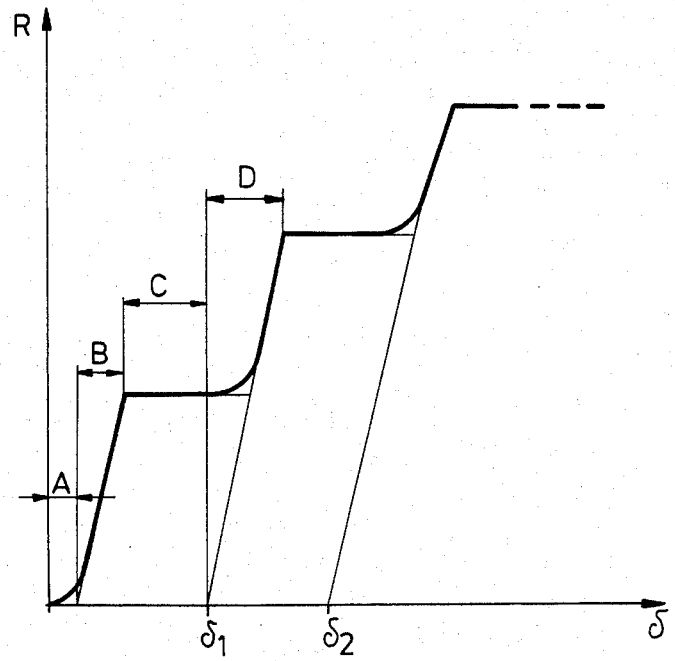

When the ground moves off in horizontal direction during an earthquake's motions, the displacement is absorbed first by the gap between the mild steel mandrels and the bushings, while the sandwich system 5 displays gradually increasing resistance. This event is shown in FIG. 3, where the horizontal displacement is marked on the horizontal axis and the resistance R of the system is marked on the vertical axis.

Following the free displacement of the extremely short phase A/meanwhile only the elastic padding is subjected to deformation/, the elastic deformation of the mild steel mandrels in the sliding blocks provided with expansion gap $\delta=0$ begins /phase B/. Shortly after the plastic deformation /phase C/ following the elastic deformation, the next phase begins, i.e. an elastic deformation /phase D/ of the mild steel mandrels of the sliding blocks formed with expansion gap $\delta_1$ takes place.

Thereafter the process is similar until the energy of the earthquake is absorbed by the mild steel mandrels in the sliding blocks build in with increasing expansion gaps.

Thus the spring system built into the whole building is capable of functioning according to the extent of the deformation. This way a system ensuring the hardening or progressive shock absorption is provided, in which the behavior of the consecutive spring elements is elastic followed by plastic deformation.

In view of the foregoing it is evident that the system according to the invention provides a realization hardening progressive shock absorption in the system used for reducing the seismic load of the buildings and thereby prevent the plastic condition of the whole spring system in case of earthquakes of a given intensity. Thus the system is suitable for the absorption or elimination of relatively high horizontal forces and its behavior is accurately calculable in advance.

Further, a prominent advantage of the system is that the spring elements can be prefabricated and their building into the foundation and into the superstructure is required only on the construction site. In this case it is expedient to embed the steel mandrels not directly into the superstructure, but into the separately prefabricated block marked with dashed line in FIG. 1. The construction shown is merely an example and the method according to the invention is feasible in several other alternatives as well.

What we claim is:

1. A progressive motion-damping shock absorption system for reducing the seismic load of a superstructure of a building comprising:

(a) a building foundation defining a plurality of recesses defined by recess walls;

(b) a plurality of energy-absorbing blocks each disposed in a respective recess forming sliding surfaces, said blocks being configured to define a pair of expansion gaps between opposite sides of said block and its respective recess wall and further configured to allow slideable movement in said recess horizontally between opposite recess walls in a respective given direction, the recesses and the blocks being further configured to allow movement of the blocks in various different given directions with respect to the foundation;

(c) a plurality of mandrels secured to the superstructure of the building and disposed in holes disposed in said blocks; and (d) elastic padding made of foam rubber saturated with bitumen disposed in said gaps.

2. System as claimed in claim 1, wherein said blocks and said sliding surfaces offer a low friction coefficient.

3. System as claimed in claim 1, wherein said sliding surface is selected from the group consisting of a graphite or teflon layer.

4. System as claimed in claim 1, wherein said expansion gaps are filled with elastic padding.

5. System as claimed in claim 1, wherein the widths of the expansion gaps are successively increased by discrete amounts.

6. A system as in claim 1, wherein said mandrel is made of steel.

7. A system as in claim 6, wherein said blocks are made of steel.

8. A system as in claim 1, wherein one of said gaps has an exceedingly small width and functions to stop the superstructure from drifting.

9. A system as in claim 1, wherein said mandrels are deformable.

10. A system as in claim 1, further comprising means for anchoring the superstructure.

* * * * *